US007044334B2

(12) United States Patent
Mita et al.

(10) Patent No.: US 7,044,334 B2
(45) Date of Patent: May 16, 2006

(54) DOUBLE CONTAINER

(75) Inventors: Nobuyuki Mita, Tokyo (JP); Mitsugu Iwatsubo, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/312,885

(22) PCT Filed: Feb. 27, 2001

(86) PCT No.: PCT/JP01/01464

§ 371 (c)(1),
(2), (4) Date: Mar. 18, 2003

(87) PCT Pub. No.: WO02/04308

PCT Pub. Date: Jan. 17, 2002

(65) Prior Publication Data

US 2004/0011810 A1 Jan. 22, 2004

(30) Foreign Application Priority Data

Jul. 6, 2000 (JP) ..... 2000-204967

(51) Int. Cl.
*B65D 35/22* (2006.01)

(52) U.S. Cl. ..... 222/94; 222/95; 222/105; 222/212; 222/386.5; 222/481.5

(58) Field of Classification Search ..... 222/94–95, 222/131, 183, 192, 190, 189.09, 481.5, 212, 222/215, 105, 92, 494, 213–214, 386.5
See application file for complete search history.

(56) References Cited

U.S. PATENT DOCUMENTS

| | | | | |
|---|---|---|---|---|
| 863,260 | A * | 8/1907 | Butterfield | 401/152 |
| 4,209,027 | A * | 6/1980 | Morganroth | 132/212 |
| 4,760,937 | A * | 8/1988 | Evezich | 222/95 |
| 5,332,121 | A * | 7/1994 | Schmidt et al. | 222/95 |
| 5,513,761 | A * | 5/1996 | Kobayashi et al. | 215/12.1 |

(Continued)

FOREIGN PATENT DOCUMENTS

| | | |
|---|---|---|
| JP | 168346/1987 | 10/1987 |
| JP | 04-339759 | 11/1992 |

(Continued)

*Primary Examiner*—Frederick C. Nicolas
(74) *Attorney, Agent, or Firm*—Oblon, Spivak, McClelland, Maier & Neustadt, P.C.

(57) ABSTRACT

A double container including an outer container having flexibility and communicating with the outside air, and an inner bag holding contents, with a space defined between the outer container and inner bag. The contents include a component which generates gas by decomposition and a volatile component and the inner bag has permeability to decomposition gases evolved by the decomposing component of the contents. The decomposition gases evolved permeate through the inner bag without difficulty for easy discharge into the outside while the volatile gases evolved from the volatile components are allowed to stay in the space on the outer side of the inner bag, making it difficult for the newly evolved volatile gases to permeate through the inner bag, thereby limiting dispersion of the volatile gases and effectively suppressing deterioration of hairdye.

7 Claims, 4 Drawing Sheets

U.S. PATENT DOCUMENTS

| | | | | |
|---|---|---|---|---|
| 5,615,803 | A * | 4/1997 | Hatakeyama et al. | 222/94 |
| 5,711,454 | A * | 1/1998 | Kobayashi et al. | 222/95 |
| 5,813,571 | A * | 9/1998 | Gaucher | 222/95 |
| 6,000,534 | A * | 12/1999 | Koomruian, Jr. | 206/5.1 |
| 6,332,726 | B1 * | 12/2001 | Yamamoto et al. | 401/183 |
| 6,334,449 | B1 * | 1/2002 | Burrowes et al. | 132/114 |
| 6,505,986 | B1 * | 1/2003 | Oder | 401/183 |
| 6,959,840 | B1 * | 11/2005 | Iwatsubo | 222/94 |

FOREIGN PATENT DOCUMENTS

| | | | |
|---|---|---|---|
| JP | 05-077345 | | 3/1993 |
| JP | 05-310265 | | 11/1993 |
| JP | 10-329850 | | 12/1998 |
| JP | 2000-016470 | | 1/2000 |
| WO | WO9926596 | * | 6/1999 |

* cited by examiner

DOUBLE CONTAINER

FIELD OF THE INVENTION

This invention relates to a double container containing contents which include a component which generates gases by decomposition.

BACKGROUND ART

A double container composed of at least two layers of an outer layer and an inner layer is described as a laminated bottle, for example, in, among others, Japanese Patent Application Laid-Open Nos. 4-339759, 5-77345 and 5-310265. According to the such double container, even in the event contents such as agricultural chemical, cosmetic material, shampoo and the like filled and held in the inner layer are reduced in capacity, only the inner layer is deformed but the external configuration of the bottle can be retained by the outer layer.

However, according to the such conventional double container, since no space is defined between the outer layer (outer container) and the inner layer (inner bag) and the container is formed of such a material as nylon, for example, which hardly allows gas to permeate therethrough, the inner layer is swollen by generated decomposition gas in case contents including a component such as, for example, hairdye, which generates decomposition gas such as $O_2$ and $CO_2$ are held in the container, and the container is broken.

DISCLOSURE OF THE INVENTION

It is an object of the present invention to provide a double container capable of holding contents including a component which generates decomposition gas while removing the decomposition gas evolved, without breakage of the container.

The present invention has achieved the above object by providing a double container comprising an outer container having flexibility and allowing the inner side of the container to communicate with the outside air, and an inner bag holding contents, with a space defined between the outer container and the inner bag, wherein the contents include a component which generates gas by decomposition and a volatile component and the inner bag has permeability to decomposition gases evolved by the decomposing component of the contents.

The permeability performance of the inner bag with respect to the decomposition gas is measured in accordance with an A-method (differential pressure method) in a method for testing permeability of gas for a plastic film or sheet stipulated in JIS K 7126. The expression of permeability to decomposition gas is referred to as a permeation coefficient, for example, of $O_2$ is $0.5\times10^{-7}$ ($cm^3$*cm/$cm^2$*s*Pa) or larger when the measuring temperature is 25° C.

As the material composing the inner bag, there can be listed silicon, natural rubber, low, density polyethylene, high density polyethylene, polystyrene, polypropylene, ionomer, polyester-based elastomer, and the like. Any one of them is formed into the inner bag having a thickness, preferably, of 10 to 1000 μm.

BRIEF DESCRIPTION OF DRAWINGS

FIG. 1(*b*) is an explanatory view of a peelable laminated container equipped with a double container according to one embodiment of the present invention.

FIG. 2(*b*) is an enlarged sectional view for explaining the flow of the contents and air in the peelable laminated container of FIG. 1.

FIG. 3(*b*) is an explanatory view of a double container according to another embodiment of the present invention.

BEST MODE FOR CARRYING OUT THE INVENTION

Figure 1A:
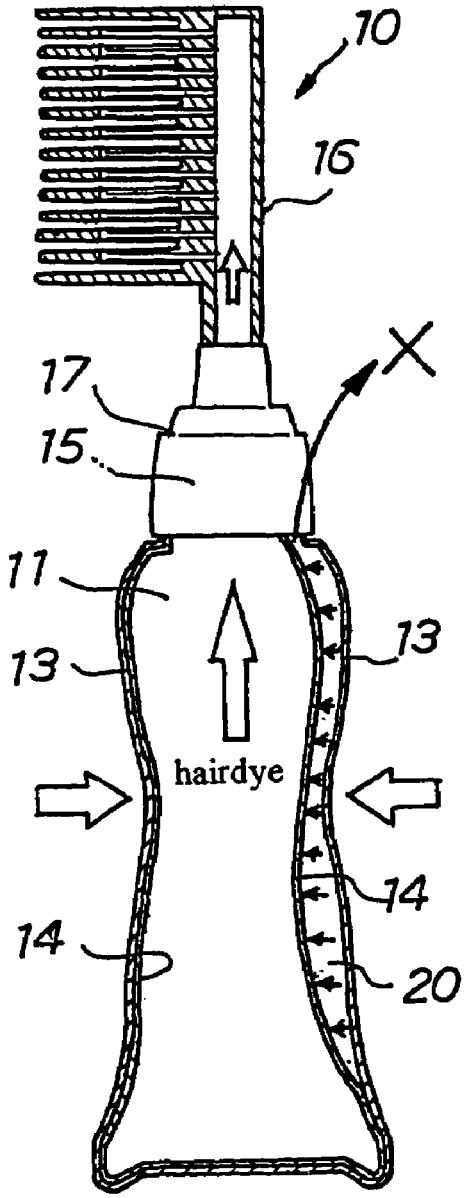
FIG. 1(*a*) is an explanatory view of a peelable laminated container equipped with a double container according to one embodiment of the present invention.
Figure 1B:
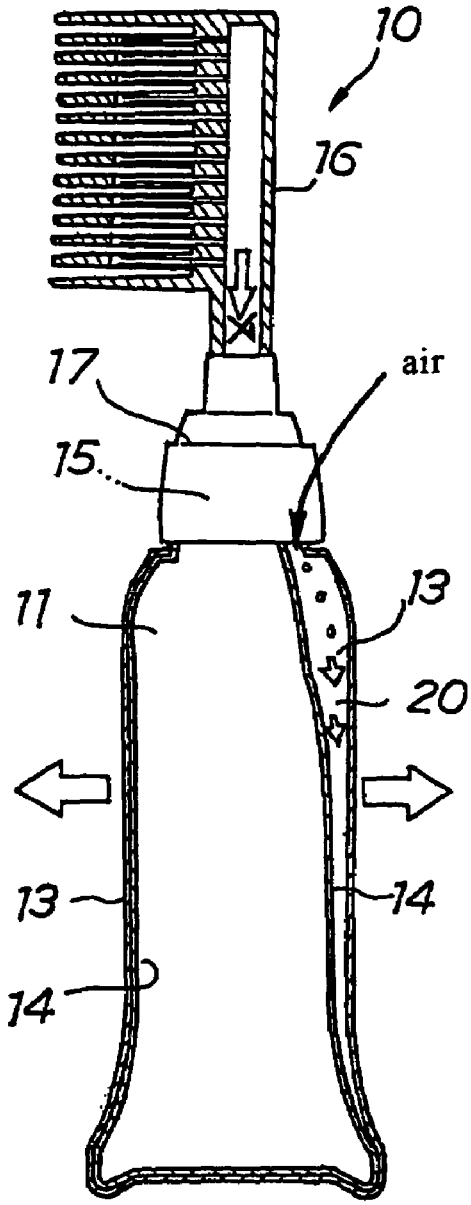

A double container of FIGS. 1(*a*) and 1(*b*) according to one preferred embodiment of the present invention constitutes a bottle main body 11 of a peelable laminated container 10 for hairdye. It comprises an outer container 13 having flexibility and communicating with the outside air through an air hole 12 (see FIG. 2), and an inner bag 14 disposed within the outer container 13 and holding hairdye as a content. A space 20 is defined between the outer container 13 and the inner bag 14.

The outer container 13 is a generally circular cylindrical container made of polyethylene, for example. The outer container 13 has flexibility enough to flatly deforming the outer container 13 by pressing the outer container 13 held in hand and shape-retainability enough to make the outer container 13 to naturally return to its original generally circular cylindrical configuration when the pressing state is released. Accordingly, by discharging the hairdye held in the inner bag 13 by pressing the outer container 13, the peelable laminated container 10 can be functioned as a squeeze container.

The inner bag 14 is a bag-shaped container made of polystyrene having a thickness of about 100 μm, for example. The inner bag 14 is attached to the inner surface of the outer container 13 in a peelable and intimately contacted manner only excepting the area right under the air hole 12 formed in the outer container 13. The inner bag 14 together with the outer container 14 constitutes a double container. A non-contacted area right under the air hole 12 is defined as the space 20 between the outer container 13 and the inner bag 14. The decomposition gas and volatile gas generated from the hair dye held in the inner bag 14 and permeated through the inner bag 14 stays in this space 20. After the discharging operation is made by pressing the outer container 13, air is fed into the space 20 through the air hole 12 while releasing the pressing state and the inner bag 14 is peeled off while being contracted, thereby enabling to function the peelable laminated container 10 as a peelable container.

Figure 2A:
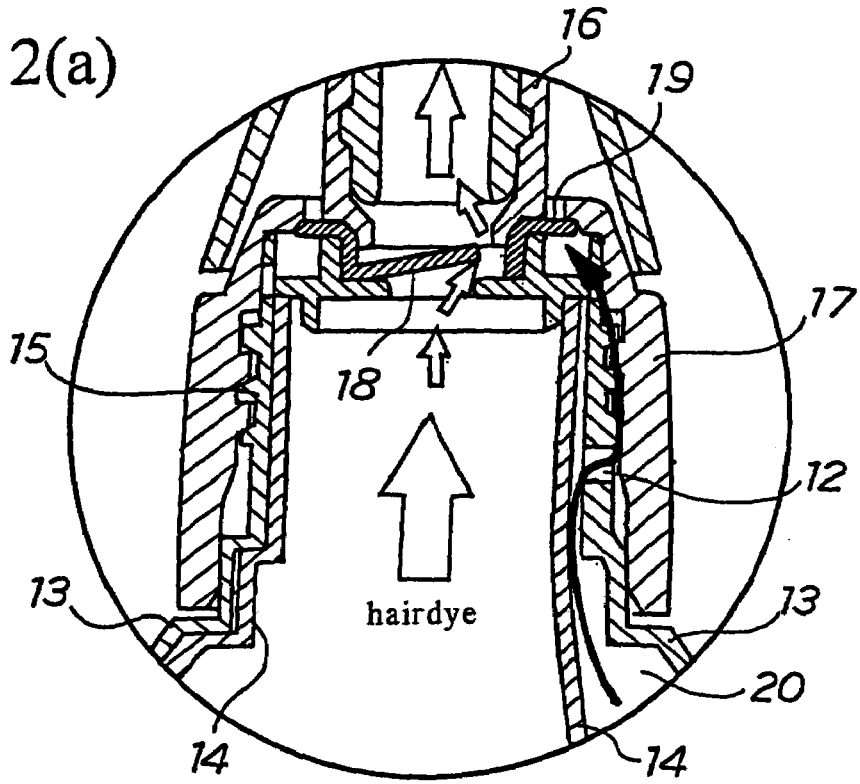
FIG. 2(*a*) is an enlarged sectional view for explaining the flow of the contents and air in the peelable laminated container of FIG. 1.
Figure 2B:
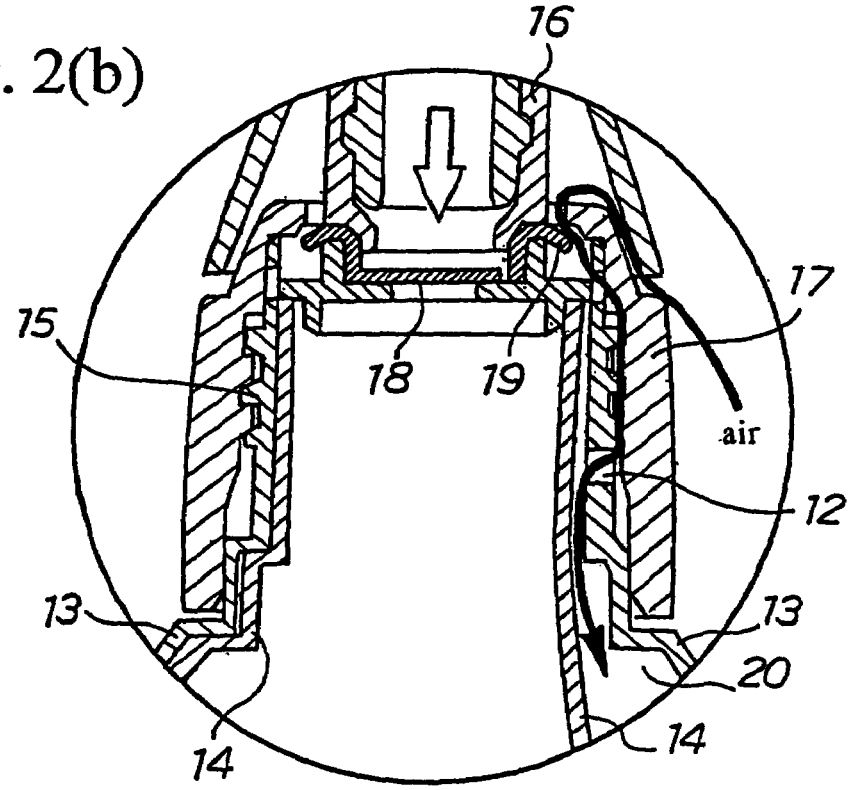

According to this peelable laminated container 10, a basal end cap part 17 of a comb-equipped outlet nozzle 16 is attached to a port neck part 15 of the bottom main body 11. As shown in FIG. 1(*a*), when the bottle main body 11 is pressed (squeezed), as shown in FIG. 2(*a*), an air valve 19 placed on the basal end cap part 17 attached to the port neck part 15 is closed to prohibit the air, volatile gas, etc. stayed in the space 20 from flowing out. On the other hand, the inner bag 14 is compressed to flow the hairdye into the outlet nozzle 16 through an outlet port of the port neck part 15 while opening a liquid outlet valve 18 placed on the basal end cap part 17. By this, the comb-equipped outlet nozzle 16 is made ready for hairdye operation.

On the other hand, as shown in FIG. 1(*b*), when the pressing state of the bottle main body 11 is released, the bottle main body 11 tends to return into the original configuration by its shape retainability and flexibility. At that time, the inside of the bottle main body 11 becomes negative in pressure and the liquid outlet valve 18 in its open position is, as shown in FIG. 2(*b*), closed to prohibit the discharged hairdye from being flowed back, and the air valve 19 is opened to allow new air to feed into the space 20 between the outer container 13 and the inner bag 14 while further peeling the inner bag 14 off the inner surface of the outer container 13. The peelable laminated container 10 according to this embodiment performs the hair-dyeing operation through the comb-equipped outlet nozzle 16 while discharging the hairdye by means of repetition of pressing state and releasing state of the bottle main body 11.

According to this embodiment, the hairdye held in the inner bag 14 includes a component which generates $O_2$ by decomposition of $H_2O_2$ and a volatile component such as moisture and alcoholic components. On the other hand, the polystyrene-made inner bag 14 holding the hairdye has a considerable permeability of about 0.5 to $5.0\times10^{-7}$ of permeability factor (permeation coefficient) with respect to $O_2$ as decomposition gas when the measuring temperature is 25° C.

Thus, according to this embodiment, even if $O_2$ is generated by decomposition of the decomposing component of the hairdye held in the inner bag 14, it permeates through the inner bag 14 without difficulty and flows into the space 20 for easy discharge into the outside from the outer container 13. Thus, the bottle main body 11 can easily be avoided from being broken which would otherwise occur by expansion of the inner bag 14.

According to this embodiment, the inner bag 14 allows the volatile gas evolved by a volatile component such as moisture and alcoholic components to permeate therethrough and the volatile gas thus permeated stays in the space 20 on the outside of the inner bag 14, making it difficult for the newly evolved volatile gas to permeate through the inner bag 14, thereby limiting dispersion of the volatile gas and effectively suppressing deterioration of the hairdye. The such effect of limiting dispersion of the volatile gas becomes more manifest when the concentration of the volatile gas in the space 20 is in a saturated condition.

Figure 3A:
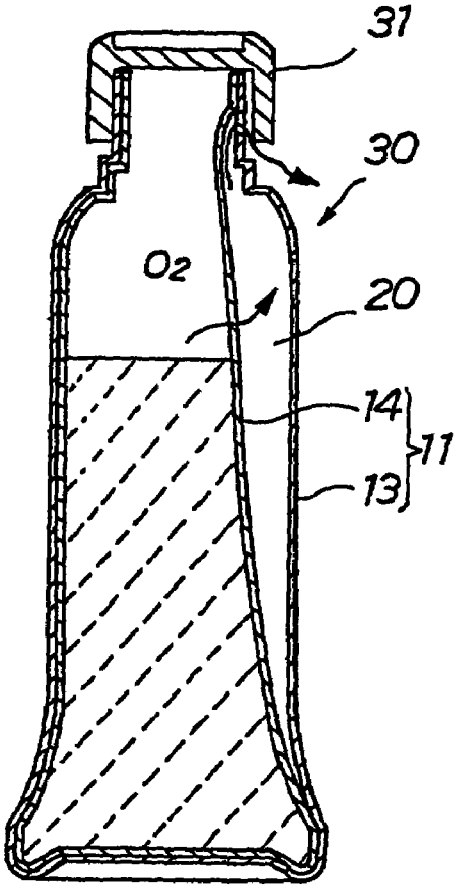
FIG. 3(*a*) is an explanatory view of a double container according to another embodiment of the present invention.
Figure 3B:
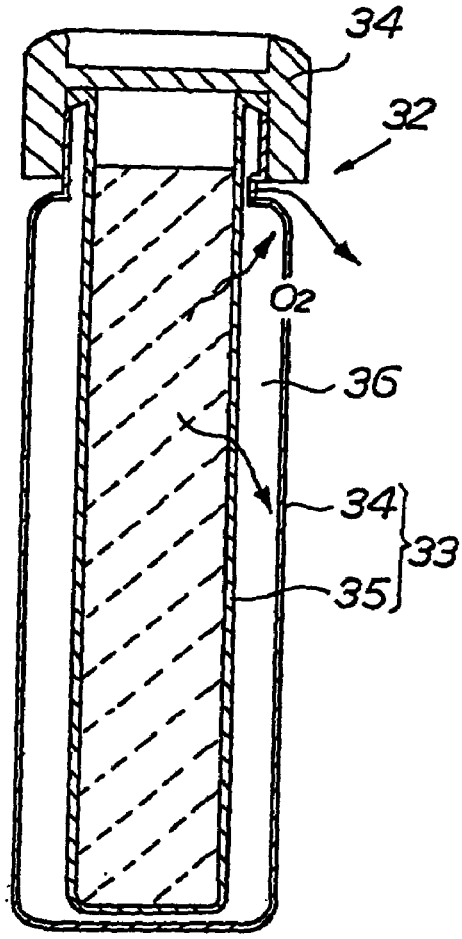

FIGS. 3(*a*) and 3(*b*) show double containers according to another embodiment of the present invention. A container (30) of FIG. 3(*a*) is in a state in which a cap 31 is attached to the bottle main body 11 of the peelable laminated container 10 according to the above-mentioned embodiment and the container 30 is in a storage state before being used as a peelable container. The bottle main body 11 as a double container comprises an outer container 13 made of polyethylene and an inner bag 14 which is made of polyethylene having a thickness of about 100 μm and which holds hairdye therein, the inner bag 14 being attached to the inside of the outer container 13. A container 32 of FIG. 3(*b*) constitutes a hairdye refilling container in which a cap 34 is attached to a container main body 33. The container main body 33 as a double container comprises a polyethylene-made outer container 34, and an inner bag 35 which is made of silicon having a thickness of about 100 μm and which holds hairdye therein. The inner bag 35 is attached to the inside of the outer container 34 without being intimately contacted with the inner surface of the outer container 34. Accordingly, a space 36 defined between the outer container 34 and the inner bag 35 is disposed over the entire periphery of the inner bag 35.

With use of those containers 30, 32, $O_2$ as decomposing gas also permeates through the inner bags 14, 35 without difficulty for easy discharge into the outside, and the volatile gas permeated through the inner bags 14, 15 is allowed to stay in the spaces 20, 36 on the outside of the inner bags 14, 35, making it difficult for the newly evolved volatile gas to permeate through the inner bags 14, 35, thereby limiting dispersion of the volatile gas and effectively suppressing deterioration of the hairdye.

Figure 4:
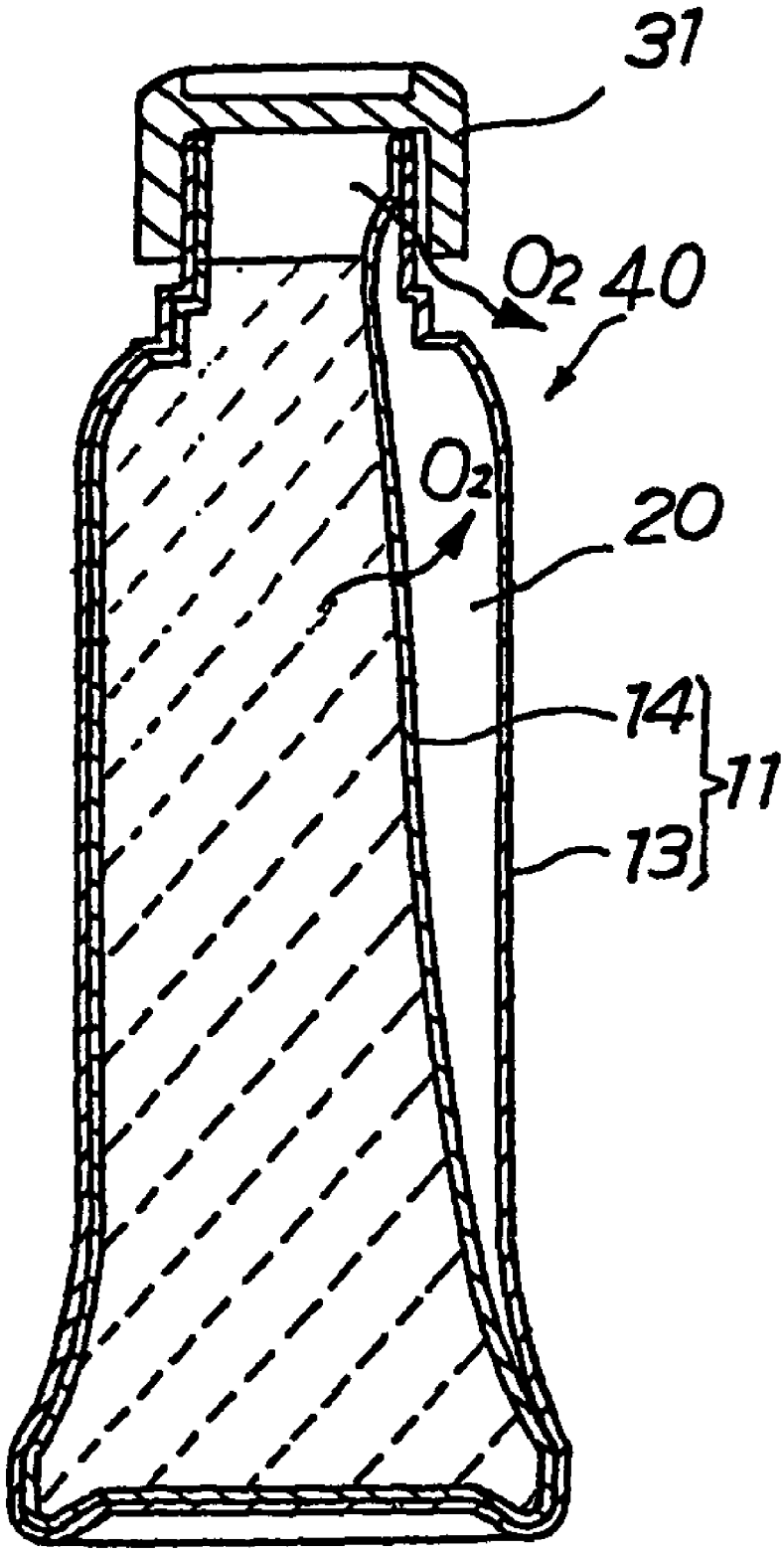
FIG. 4 is an explanatory view of a double container according to a further embodiment of the present invention.

FIG. 4 shows a double container according to a further embodiment of the present invention. A container 40 of this embodiment has, as in the case with the container 30 shown in FIG. 3(*a*), a constitution in which a cap 31 is attached to a bottle main body 11 as a double container, but it is different in quantity of the hairdye held in an inner bag 14. That is, since hairdye of a capacity of 90 to 100% with respect to the capacity of the inner bag 14 is held in the inner bag 14, the capacity of a non-holding space (head space) of hairdye at an upper end part within the inner bag 14 is so small as 10 to 0% with respect to the capacity of the inner bag 14. Accordingly, at the time when $O_2$ as decomposing gas flows into the head space 41 from an upper boundary surface of the hairdye held in the inner bag 14, a partial pressure of the decomposing gas to be mixed with air, etc. remaining in the head space 41 becomes high compared with a case in which the head space is large in capacity. For this reason, the partial pressure difference between the partial pressure of the decomposing gas in the atmospheric air and the partial pressure of the decomposing gas in the head space 41 is increased to enhance permeation of the decomposing gas through the inner bag 14. This makes it possible to smoothly remove the decomposing gas from the inner bag 14, thereby more effectively avoiding breakage of the bottle main body 11, which would otherwise occur by expansion of the inner bag 14, at the time of storing the container 40.

The present invention is not limited to the above embodiments. For example, the outer container is not necessarily a polyethylene-made container but it can be made using various kinds of material having flexibility. Moreover, the material composing the inner bag is not necessarily polystyrene and silicon. Moreover, the contents held in the inner bag are not necessarily a liquid hairdye but various kinds of substances, such as chemicals, including a component which generates gas by decomposition and a volatile component may be held in the inner bag.

INDUSTRIAL APPLICABILITY

According to a double container of the present invention, it can hold therein contents including a component generating a composing gas while removing the decomposing gas evolved, without breakage of the container.

The invention claimed is:

1. A double container comprising an outer container having flexibility and allowing an inner side of said container to communicate with the outside air, and an inner bag holding contents, with a space defined between said outer container and said inner bag, wherein said contents include a decomposing component which generates gas by decomposition and a volatile component and said inner bag has permeability to decomposition gases evolved by the decomposing component of said contents and volatile gases, and said decomposition gases permeate through said inner bag while said volatile gases permeated through said inner bag remain in the space, so that newly evolved volatile gases are inhibited from permeating through said inner bag, thereby limiting dispersion of said volatile gases.

2. The double container according to claim 1, wherein said contents of a capacity of 90 to 100% with respect to a capacity of said inner bag is held in said inner bag.

3. The double container according to claim 1, wherein said double container is a squeeze container which discharges said contents held in said inner bag, through an outlet port by pressing said outer container.

4. The double container according to claim 1, wherein said double container is a peelable laminated container, in which said inner bag is attached to an inner surface of said outer container in a peelable and intimately contacted manner and said inner bag is contracted while being peeled by feeding air into the space between said outer container and said inner bag.

5. The double container according to claim 1, wherein said inner bag has a permeability of about 0.5 to $0.5\times10^{-7}$ of permeability factor (permeation coefficient) with respect to $O_2$ as decomposition gas when the measuring temperature is 25° C.

6. The double container according to claim 2, wherein said double container is a squeeze container which discharges said contents held in said inner bag, through an outlet port by pressing said outer container.

7. The double container according to claim 2, wherein said double container is a peelable laminated container, in which said inner bag is attached to an inner surface of said outer container in a peelable and intimately contacted manner and said inner bag is contracted while being peeled by feeding air into the space between said outer container and said inner bag.

* * * * *